US006579122B1

(12) United States Patent
Chen

(10) Patent No.: US 6,579,122 B1
(45) Date of Patent: Jun. 17, 2003

(54) CONNECTOR FOR PORTABLE OR HAND-HELD ELECTRONIC DEVICE

(75) Inventor: Yen-Hung Chen, Taipei (TW)

(73) Assignee: Jess-Link Products Co., Ltd., Taipei (TW)

( * ) Notice: Subject to any disclaimer, the term of this patent is extended or adjusted under 35 U.S.C. 154(b) by 0 days.

(21) Appl. No.: 10/046,701

(22) Filed: Jan. 17, 2002

(51) Int. Cl.[7] ..... H01R 13/73
(52) U.S. Cl. ..... 439/570
(58) Field of Search ..... 439/569–572

(56) References Cited

U.S. PATENT DOCUMENTS 5,961,347 A * 10/1999 Hsu ..... 439/570
6,083,045 A * 7/2000 Chiu ..... 439/570
6,231,364 B1 * 5/2001 Liu ..... 439/570

* cited by examiner

*Primary Examiner*—Gary Paumen
(74) *Attorney, Agent, or Firm*—Jacobson Holman PLLC

(57) ABSTRACT

A connector for a portable or hand-held electronic device is mainly composed of male and female connectors. Two sides of the male connector are disposed with inserting ports caused by an U-shaped metal piece on the outside thereof. A narrow sliding groove, a positioning opening, a flat sliding groove and a flat inserting opening are respectively disposed on two sides of the male connector. A hook piece, an inserting hook piece and a convex retaining piece are on the U-shaped metal piece for allowing the U-shaped metal piece to be tightly assembled to the male connector. The rear of the U-shaped metal piece bends to form two contact footing pieces, and together with another contact footing piece are used for fastening the male connector horizontally or vertically onto the circuit board.

1 Claim, 6 Drawing Sheets

CONNECTOR FOR PORTABLE OR HAND-HELD ELECTRONIC DEVICE

BACKGROUND OF THE INVENTION

1. Field of the Invention

The present invention relates to a connector for a portable or hand-held electronic device. More specifically, to a male connector installed in a Personal Digital Assistant (PDA) with a U-shaped metal piece tightly retained onto two sides thereof and fixedly installed onto a circuit board horizontally or vertically by the U-shaped metal piece.

2. Prior Art

In the prior art, a male connector (a) and a female connector (b) are connected, as shown in FIGS. 6 and 7. A generally portable or hand-held device, such as a PDA, a mobile phone, etc., has inserting ports (a1) disposed on two sides of the male connector (a) and an inserting piece (c) with a retaining hole (c1) is mounted and situated inside the inserting port (a1) of the male connector (a). Two convex blocks (b1) corresponding to the male connector (a) are disposed on the female connector (b). The outer side of the convex block (b1) is disposed with a retaining member (b2) to make the convex block (b1) of the female connector (b) insertable into the inserting port (a1) of the male connector (a) and to make the retaining member (b2) of the convex block (b1) retainable into the retaining hole (c1) of the inserting piece (c) so as to insert and install the female connector (b) onto the male connector (a).

However, the inserting piece (c) is only disposed on two sides of the male connector (a). The inserting piece (c) are not connected onto a circuit board so that the male connector (a) is fixedly inserted and installed only by the terminals disposed. Therefore, the male connector (a) is subject to wobble, since the inserting piece (c) is of a shape that has to be tightly inserted into the inserting port (a1) of the male connector (a). It tends to deflect and disable the retaining member (b2) on the lateral side of the convex block (b1) of the female connector (b) which needs to be retained into the retaining hole (c1) of the inserting piece (c). This results in a disabling of the female connector (b) to be inserted and connected onto the male connector (a).

Furthermore, the male connector (a) is fixedly soldered onto a circuit board (d) only through the terminals thereon and that can only be horizontally or vertically installed onto the circuit board (d). It is unable to change directions according to the different designs of PDA. Therefore, it is necessary to design the male connectors in two different regulations and that increases manufacturing costs.

SUMMARY OF THE INVENTION

In view of the shortcomings of the conventional male connector (a) installed on a PDA, the present invention, a connector for a portable or hand-held electronic device, is designed mainly with male and female connectors. Two sides of the male connector are disposed by inserting ports cased by a U-shaped metal piece on the outside thereof. The features of the connector are a narrow sliding groove, a positioning opening and a flat sliding groove which are respectively disposed on the upper and the lower lateral sides of the male connector. A flat inserting opening is disposed at the distal end of the flat sliding groove. Each of the distal ends on the two side rims of the U-shaped metal piece bend inwardly to form a hook piece to be slid and fastened into the narrow sliding grooves on the upper and the lower lateral sides of the male connector. An inserting hook piece and a convex retaining piece are respectively disposed on the upper and the lower sides of the U-shaped metal piece. This allows the inserting hook piece to slide and insert into the flat inserting opening from the flat sliding groove and the convex retaining piece to be retained in the positioning opening. The U-shaped metal piece is tightly assembled on to the male connector. The rear of the U-shaped metal piece bends to form two contact footing pieces to be fixedly soldered to a circuit board and another contact footing piece is disposed on the lateral side of the U-shaped metal piece for fastening the male connector horizontally or vertically onto the circuit board.

The primary objective of the present invention is to provide a male connector to be installed on to a Personal Digital Assistant (PDA) and disposed with an U-shaped metal piece tightly retained on two sides thereof to eliminate the U-shaped metal piece from tilting and detaching.

Another objective of the present invention is to provide a male connector to be installed on a PDA and having an U-shaped metal piece mounted on two sides thereof for being fixedly installed onto a circuit board horizontally or vertically.

To enable a further understanding of the structural features and the technical contents of the present invention, the brief description of the drawings below is followed by the detailed description of the preferred embodiment.

DETAILED DESCRIPTION OF THE PREFERRED EMBODIMENTS

Figure 1:
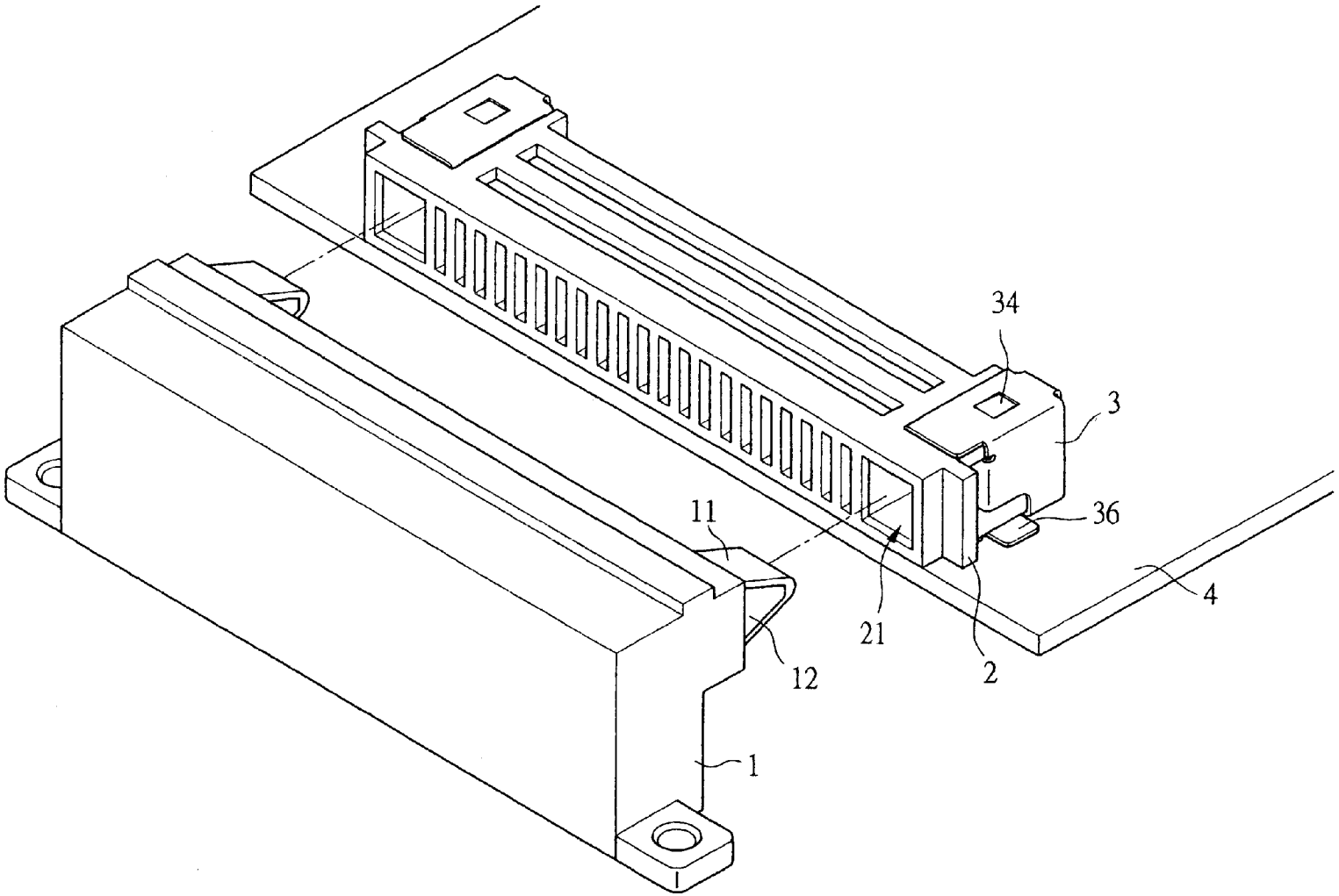
FIG. 1 is a pictorial view of the present invention.
Figure 2:
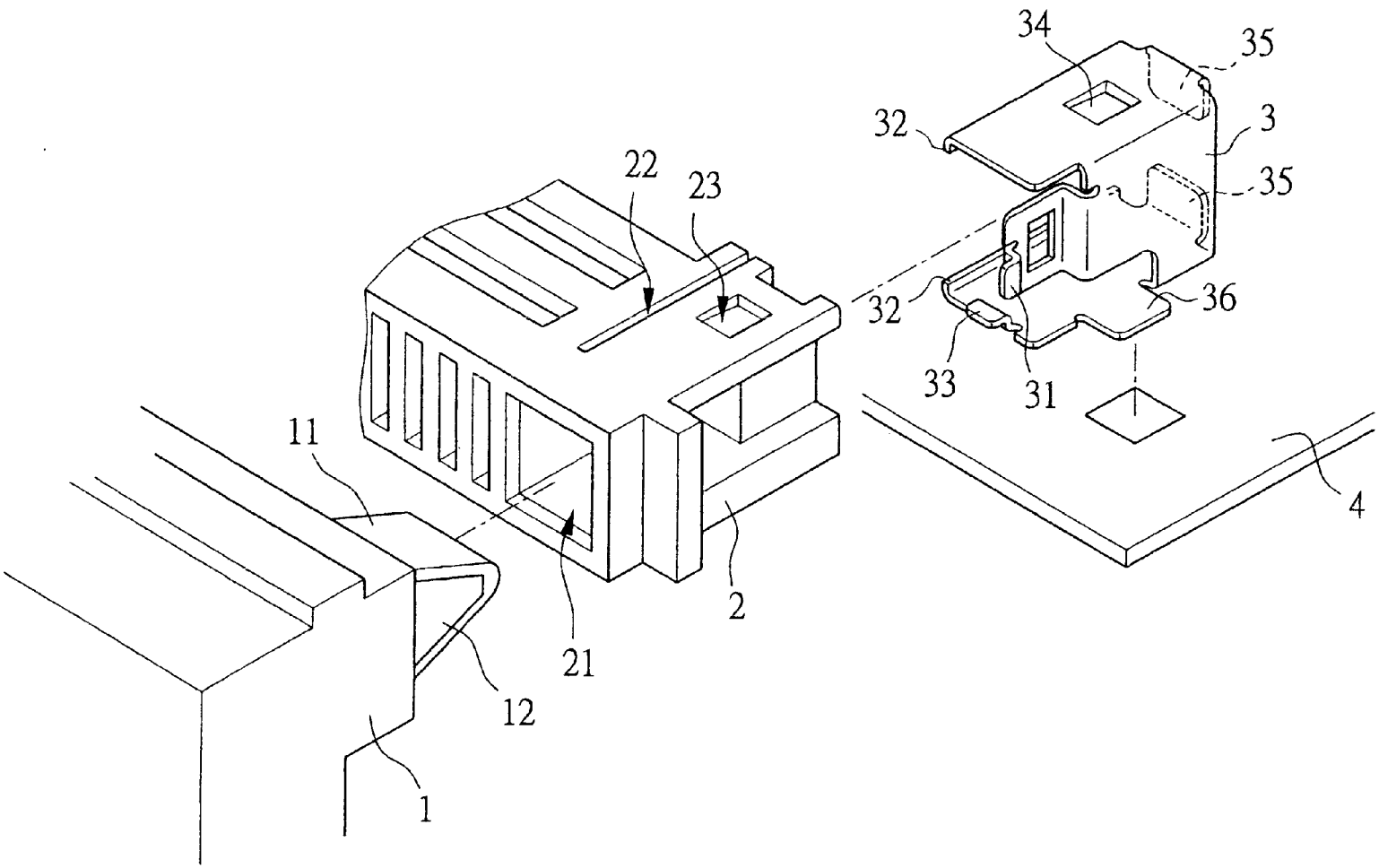
FIG. 2 is an exploded view of the present invention.
Figure 3:
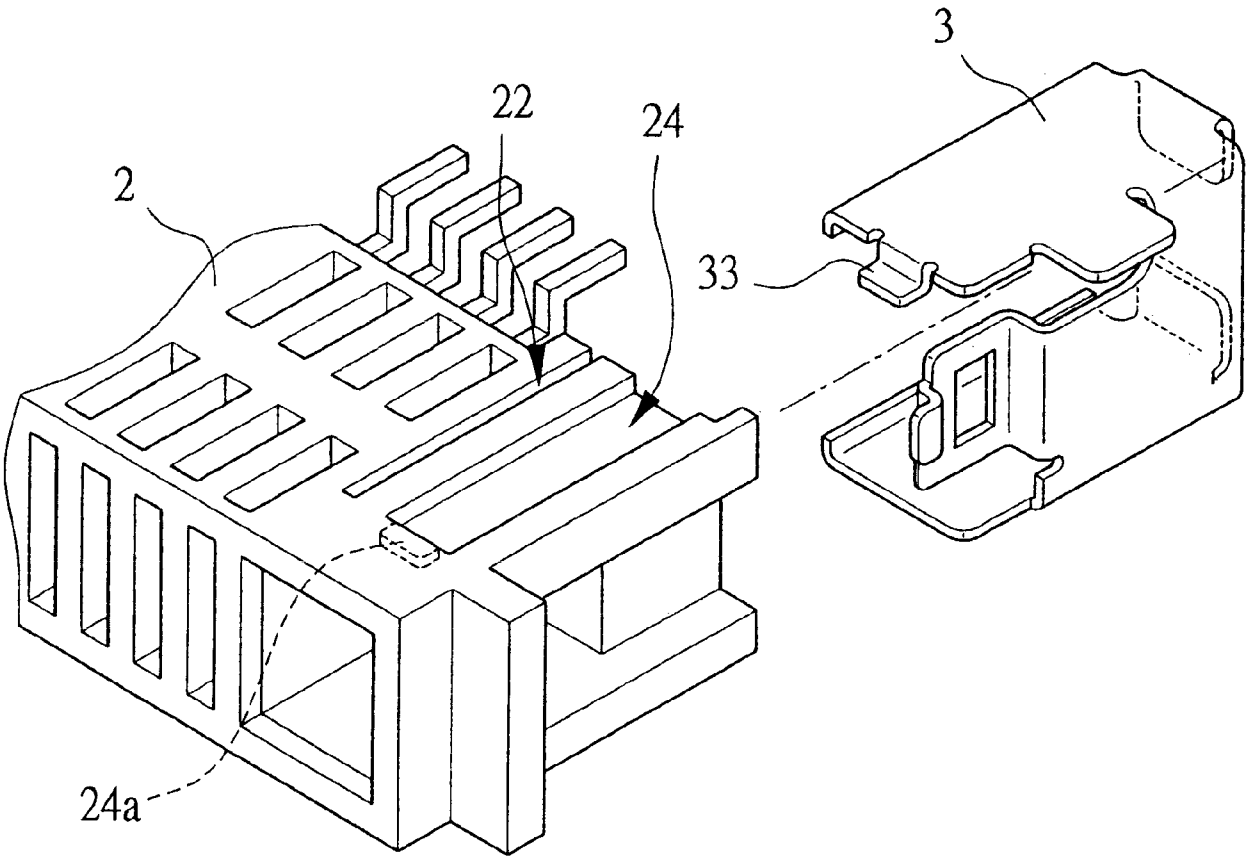
FIG. 3 is a bottom exploded view of the present invention.

Referring to FIGS. 1, 2 and 3, the present invention comprises a female connector (1) and a male connector (2). The male connector (2) is disposed with inserting ports (21) on two sides. An outside of the male connector (2) is cased by a U-shaped metal piece (3). An inserting piece (31) with a retaining hole (31*a*) is disposed at the front aspect of the U-shaped metal piece (3) and situated inside the inserting port (21) of the male connector (2). Two convex blocks (11) corresponding to the male connector (2) are disposed on the female connector (1). The outer side of the convex block (11) is disposed with a retaining member (12) to make the convex block (11) of the female connector (1) insert into the inserting port. (21) of the male connector (2) and to make the retaining member (12) of the convex block (11) retain into the retaining hole (31) of the inserting piece (31) of the U-shaped metal piece (3) so as to insert and install the female connector (1) onto the male connector (2).

A narrow sliding groove (22), a positioning opening (23) and a flat sliding groove (24) are respectively disposed on the upper and the lower lateral sides of the male connector (2). A flat inserting opening (24*a*) is disposed at the distal end of the flat sliding groove (24). Each of the distal ends on two side rims of the U-shaped metal piece (3) bend inwardly to form a hook piece (32) to be slid and fastened into the narrow sliding grooves (22) on the upper and the lower lateral sides of the male connector (2). An inserting hook piece (33) and a convex retaining piece (34) are respectively disposed on the upper and the lower sides of the U-shaped metal piece (3) allowing the inserting hook piece (33) to slide and insert into the flat inserting opening (24*a*) from the flat sliding groove (24) and allowing the convex retaining piece (34) to be retained in the positioning opening (23). The U-shaped metal piece (3) is tightly assembled on to the male connector (2). The rear aspects of the U-shaped metal piece (3) bend to form two contact footing pieces (35) to be fixedly soldered to a circuit board (4) and another contact footing piece (36) is disposed on the lateral side of the U-shaped metal piece (3) for fastening the male connector (2) horizontally or vertically onto the circuit board (4).

According to the mentioned structure, the hook piece (32) is disposed to bend oppositely on the inner lateral side of the U-shaped metal piece (3) which is to be slid and retained into the narrow grooves (22) on the upper and the lower sides of the male connector (2). The inserting hook piece (33) and the convex retaining piece (34) disposed on the upper and the lower sides of the U-shaped metal piece (3), allow the inserting hook piece (33) to slide into the flat inserting opening (24*a*) through the flat sliding groove (24) of the male connector (2) and make the retaining piece (34) of the U-shaped metal piece (3) retain in the positioning opening (23) of the male connector (2). The inserting hook piece (33) and the convex retaining piece (34) of the upper and the lower sides of the U-shaped metal piece (3) are respectively inserted and assembled into the positioning opening (23) and the flat inserting opening (24*a*) of the male connector (2). This stables the U-shaped metal piece (3) onto two sides of the male connector (2) which eliminates the upper and the lower sides of the U-shaped metal piece (3) from tilting and causing the inserting piece (31) to deflect. This also makes the retaining member (12) on the lateral side of the convex block (11) of the female connector (1) stables to retain and connect with the inserting piece (31) so as to prevent the female connector (1) unable to insert and connect with the male connector (2).

Figure 4:
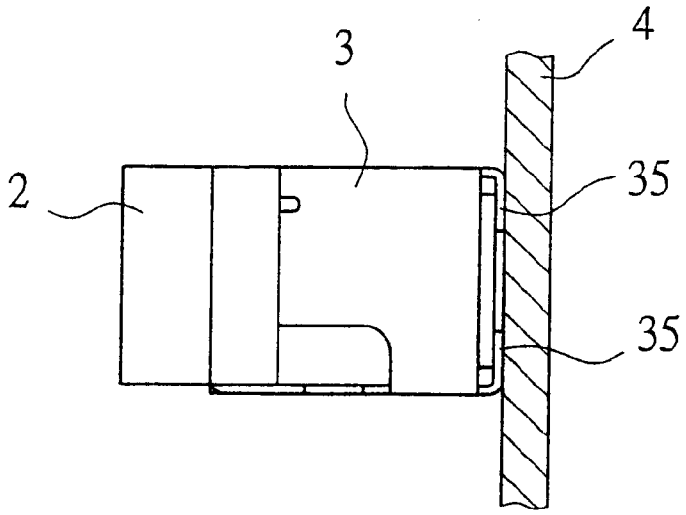
FIG. 4 is a lateral view of a male connector of the present invention vertically installed onto a circuit board.
Figure 5:
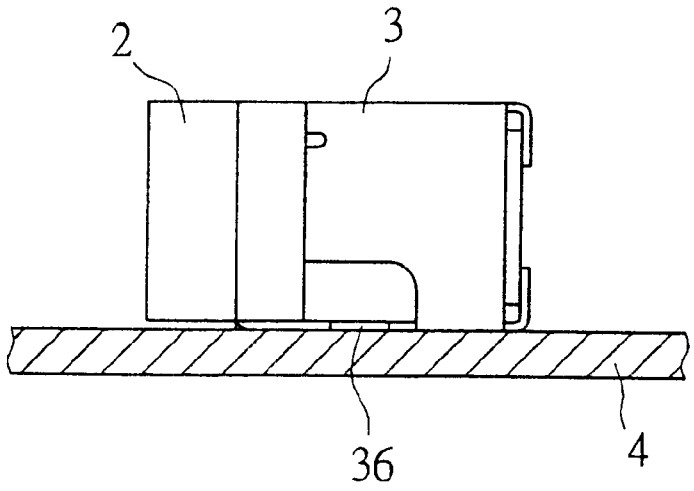
FIG. 5 is a lateral view of a male connector of the present invention horizontally installed onto a circuit board.
Figure 6:
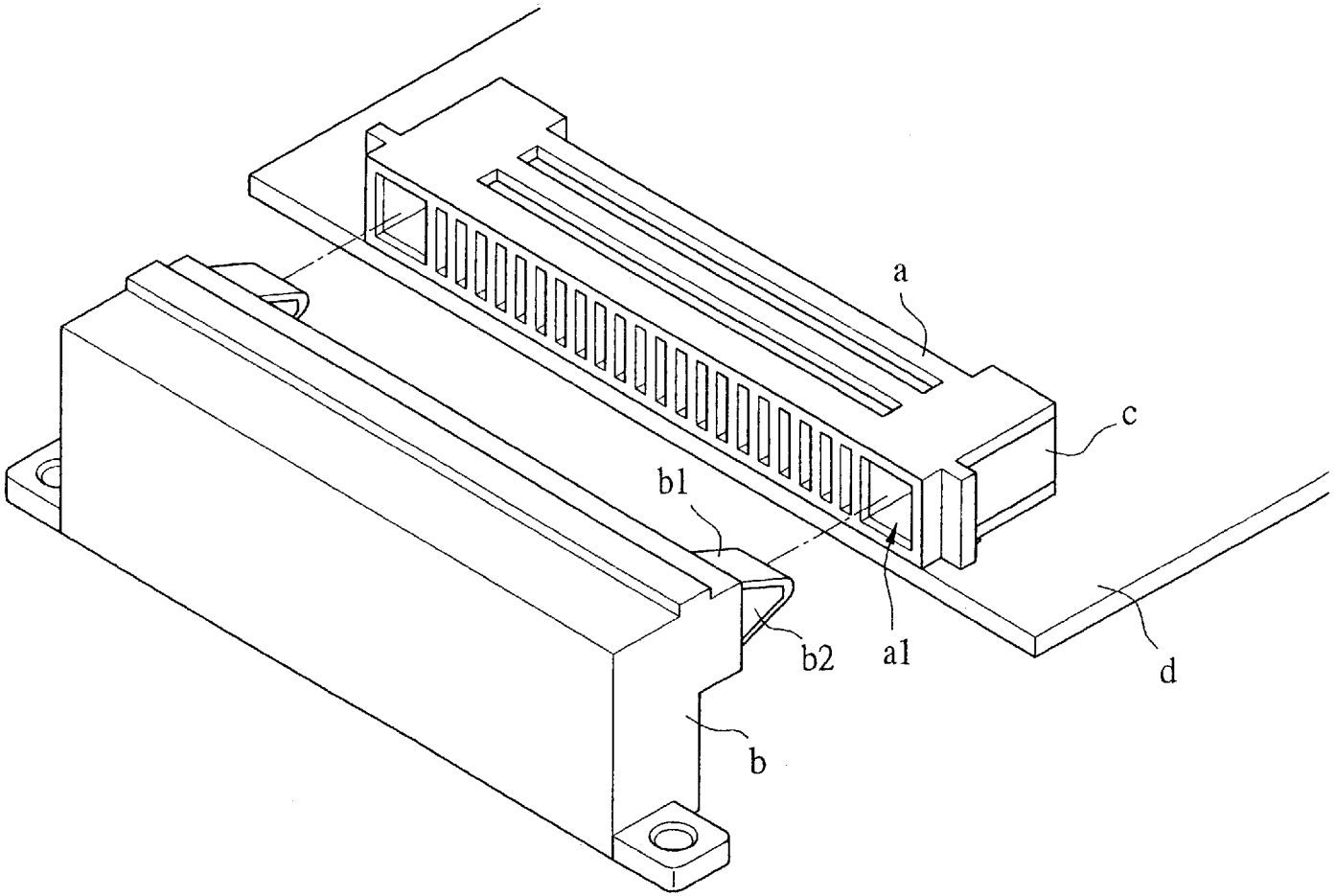
FIG.6 PRIOR ART
FIG. 6 is a pictorial view of a conventional structure.
Figure 7:
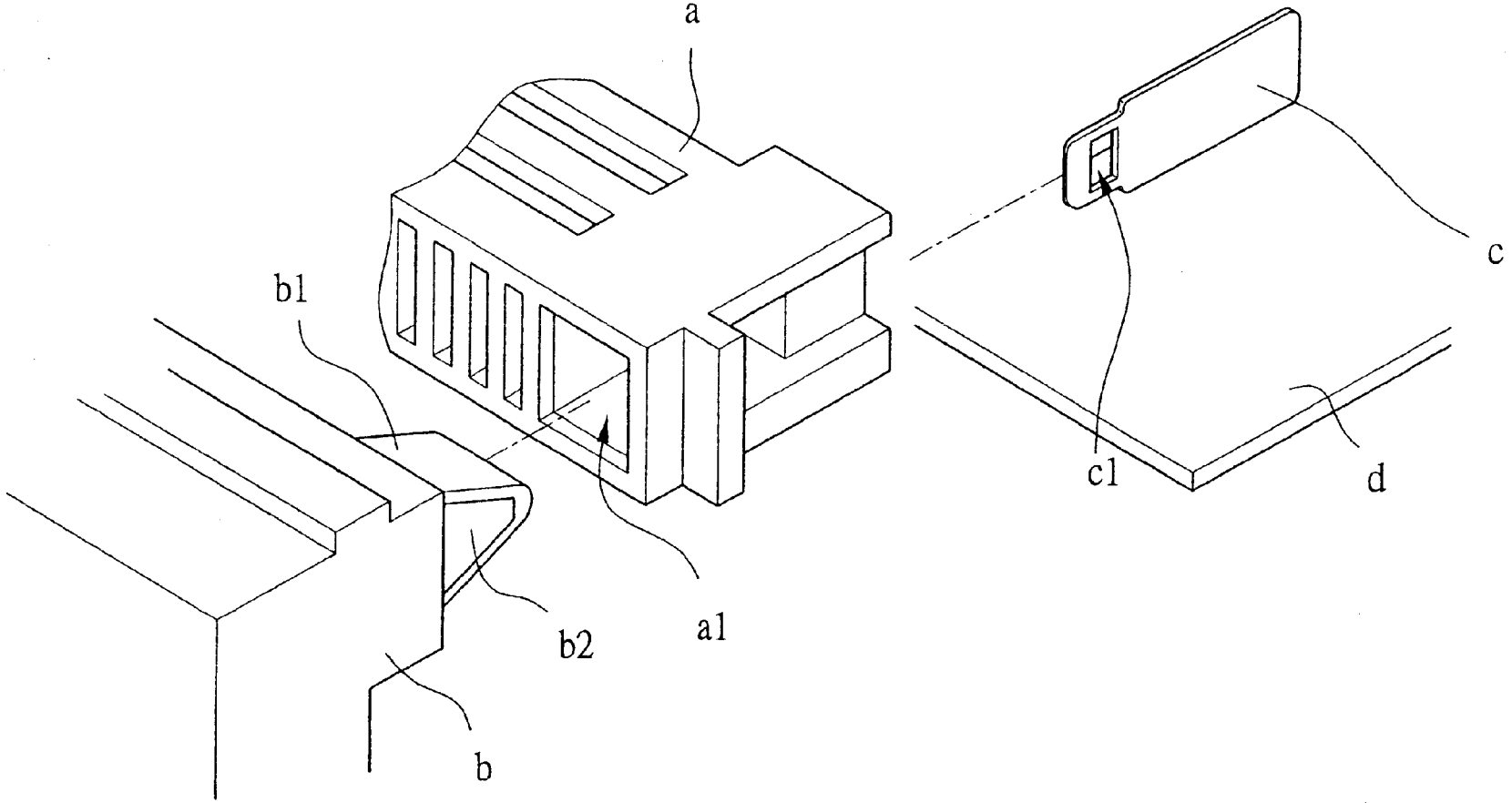
FIG. 7 is an exploded view of a conventional structure.

Furthermore, the rear of the U-shaped metal piece (3) bends to form two contact footing pieces (35) which make the male connector (2) able to be soldered onto the circuit board (4), as shown in FIG. 4. Therefore, the male connector (2) is vertically installed onto the circuit board (4). Additionally, the U-shaped metal piece (3) can be fixedly soldered onto the circuit board (4) through the other contact footing piece (36) on the lateral side thereof, as shown in FIG. 5. This permits the male connector (2) to be horizontally installed onto the circuit board (4). Therefore, the male connector (2) can be installed horizontally or vertically onto the circuit board (4) according to the different kinds of device and various selected applications.

It is of course to be understood that the embodiment described herein is merely illustrative of the principles of the invention and that a wide variety of modifications thereto may be effected by a person of ordinary skill in the art without departing from the spirit and scope of the invention as set forth in the following claim.

What is claimed is:

1. A connector for a portable or hand-held electronic device comprises:

a female connector and a male connector, said male connector being disposed with inserting ports on two sides, an outside of said male connector being cased by a U-shaped metal piece;

an inserting piece with a retaining hole being disposed at a front of said U-shaped metal piece and situated inside the inserting ports of said male connector;

two convex blocks corresponding to the male connector being disposed on said female connector, an outer side of each of said convex blocks being disposed with a retaining member for inserting the convex blocks of the said female connector into the inserting port of the male connector and for retaining the retaining member of said convex block into the retaining hole of the inserting piece of the U-shaped metal piece, wherein the female connector being inserted onto the male connector;

a narrow sliding groove, a positioning opening and a flat sliding groove being disposed on the upper and the lower lateral sides of said male connector;

a flat inserting opening being disposed at a distal end of the flat sliding groove;

each of the distal ends on two side rims of said U-shaped metal piece bend inwardly to form a hook piece, said hook piece being slid and fastened into the narrow sliding grooves on the upper and lower lateral sides of said male connector;

an inserting hook piece and a convex retaining piece being disposed on the upper and the lower sides of the U-shaped metal piece for sliding said inserting hook piece to insert the flat inserting opening from the flat sliding groove, and said convex retaining piece being retained in the positioning opening, for tightly assembling the U-shaped metal piece on the male connector; and the rear of the U-shaped metal piece being bent to form two contact footing pieces for fixedly soldering to a circuit board and another contact footing piece being disposed on the lateral side of the U-shaped metal piece for fastening the male connector horizontally or vertically onto the circuit board.

* * * * *